US011047344B2

(12) United States Patent
Huh

(10) Patent No.: US 11,047,344 B2
(45) Date of Patent: Jun. 29, 2021

(54) LEAKAGE DIAGNOSIS SUPPLEMENT METHOD FOR FAILURE OF VACUUM PUMP USING ACTIVE PURGE PUMP AND LEAKAGE DIAGNOSIS SUPPLEMENT SYSTEM FOR FAILURE OF VACUUM PUMP USING ACTIVE PURGE PUMP

(71) Applicants: HYUNDAI MOTOR COMPANY, Seoul (KR); KIA MOTORS CORPORATION, Seoul (KR)

(72) Inventor: Jeong-Ki Huh, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/673,292

(22) Filed: Nov. 4, 2019

(65) Prior Publication Data

US 2020/0224610 A1 Jul. 16, 2020

(30) Foreign Application Priority Data

Jan. 15, 2019 (KR) ..... 10-2019-0005074

(51) Int. Cl.

*F02M 25/08* (2006.01)
*F02D 41/22* (2006.01)
*F02D 41/00* (2006.01)

(52) U.S. Cl.

CPC ..... *F02M 25/0818* (2013.01); *F02M 25/089* (2013.01); *F02M 25/0809* (2013.01); *F02D 41/004* (2013.01); *F02D 2041/225* (2013.01); *F02D 2200/0406* (2013.01); *F02M 25/0836* (2013.01); *F02M 25/0872* (2013.01)

(58) Field of Classification Search

CPC ..... F02M 25/0818
See application file for complete search history.

(56) References Cited

U.S. PATENT DOCUMENTS

| | | | | |
|---|---|---|---|---|
| 7,255,093 | B2 * | 8/2007 | Iihoshi | F02M 25/0818 123/518 |
| 9,822,737 | B2 * | 11/2017 | Dudar | F02M 25/0836 |
| 10,221,811 | B2 * | 3/2019 | Kishi | F02M 25/0818 |
| 10,480,431 | B1 * | 11/2019 | Dudar | F02M 25/0854 |
| 10,760,532 | B1 * | 9/2020 | Dudar | F02M 25/0818 |
| 10,767,599 | B2 * | 9/2020 | Dudar | F02D 41/0032 |
| 2003/0110836 | A1 * | 6/2003 | Cho | F02M 25/0818 73/40.7 |
| 2006/0144370 | A1 * | 7/2006 | Iihoshi | F02M 25/0818 123/491 |

(Continued)

FOREIGN PATENT DOCUMENTS

KR 10-2003-0050120 A 6/2003

*Primary Examiner* — Kevin R Steckbauer
(74) *Attorney, Agent, or Firm* — Brinks Gilson & Lione

(57) ABSTRACT

A leakage diagnosis supplement method for a failure of a vacuum pump using an active purge pump may include: determining whether or not the vacuum pump mounted on a vent line between a canister and an atmosphere fails; reverse-rotating the active purge pump mounted on a purge line connecting the canister and an intake pipe to each other; determining whether or not an absolute value of internal pressure in a fuel tank is less than a specific value; and checking a leakage in the fuel system including the canister and the fuel tank.

4 Claims, 8 Drawing Sheets

(56) References Cited

U.S. PATENT DOCUMENTS

| | | | | |
|---|---|---|---|---|
| 2015/0285171 | A1* | 10/2015 | Dudar | F02M 25/0809 73/114.39 |
| 2018/0080415 | A1* | 3/2018 | Kishi | F02M 25/089 |
| 2019/0360412 | A1* | 11/2019 | Dudar | F02D 41/0045 |
| 2019/0360434 | A1* | 11/2019 | Dudar | F02D 41/0032 |
| 2020/0232421 | A1* | 7/2020 | Huh | F02M 35/10222 |
| 2020/0291879 | A1* | 9/2020 | Dudar | F02D 41/0032 |
| 2021/0033047 | A1* | 2/2021 | Shinaberry | F02M 25/089 |

* cited by examiner

LEAKAGE DIAGNOSIS SUPPLEMENT METHOD FOR FAILURE OF VACUUM PUMP USING ACTIVE PURGE PUMP AND LEAKAGE DIAGNOSIS SUPPLEMENT SYSTEM FOR FAILURE OF VACUUM PUMP USING ACTIVE PURGE PUMP

CROSS-REFERENCE TO RELATED APPLICATION

This application claims priority to and the benefit of Korean Patent Application No. 10-2019-0005074, filed on Jan. 15, 2019, the entire contents of which are incorporated herein by reference.

FIELD

The present disclosure relates to a leakage diagnosis supplement method for a failure of a vacuum pump using an active purge pump to determine whether or not a leakage in a fuel system occurs even when the vacuum pump with an evaporative leak check monitor (ELCM) module fails.

BACKGROUND

The statements in this section merely provide background information related to the present disclosure and may not constitute prior art.

A hybrid vehicle allows an engine to stop at an idle stop section in order to improve fuel efficiency. Thus, a fuel system leakage diagnosis method of an internal combustion vehicle, which determines whether or not a leakage occurs based on a pressure sensing signal of a pressure sensor mounted in the fuel tank at the idle state, is not able to be applied.

Accordingly, the hybrid vehicle diagnoses leakage in a fuel system using an evaporative leak check monitor (ELCM) module 1 at the engine stop state as shown in FIGS. 1 to 3.

As shown in FIG. 1, an atmospheric pressure is measured through a pressure sensor 3 in a state where a switching valve 2 is not operated, and then a vacuum pump 4 is operated so as to generate an air flow in the ELCM module 1. A reference orifice 5 is mounted on the ELCM module 1 and the pressure sensor 3 is mounted on a rear end of the reference orifice 5 based on an air flow direction. A flow rate of an air flowing into the pressure sensor 3 by the reference orifice 5 becomes constant. Accordingly, a measurement value acquired by the pressure sensor 3 reaches an arbitrary value depending on various environment variables. This arbitrary value is measured as a first reference pressure value P1.

As shown in FIG. 2, a switching valve 2 is operated to generate an air flow in the fuel system including a canister and a fuel tank. The flow rate discharged from the fuel system to an atmosphere is gradually decreased. Accordingly, the measurement value acquired by pressure sensor 3 reaches an arbitrary value and then decreases nonlinearly and reaches a specific value depending on various environment variables, as shown in FIG. 3. At this time, the reached specific value is measured as a leakage determination value P2.

When the leakage determination value P2 is measured, a purge control solenoid valve (PCSV) mounted on the purge line is opened. Since an outside air flows into the canister through the purge line, the measurement value continuously acquired by the pressure sensor 3 changes an appearance in a nonlinearly increasing manner, and thus the intensity of the signal is the same as that of the atmospheric pressure measured in advance. Failures of the PCSV and the vacuum pump 4 are diagnosed in a state where the PCSV is open, based on the nonlinear change in the measurement value acquired by the pressure sensor 3.

When the measurement value acquired by the pressure sensor 3 is the same as that of the atmospheric pressure, the PCSV is closed and the switching valve 2 is changed to a non-operated state. Since the vacuum pump 4 is operated in a state where the switching valve 2 is not operated, the air flow is re-generated in the ELCM module 1. Accordingly, the measurement value acquired by the pressure sensor 3 reaches an arbitrary value depending on various environment variables. This arbitrary value is measured as a second reference pressure value P3.

A state of the ELCM module 1 is determined and the leakage in the fuel system is determined based on the first reference pressure value P1, the leakage determination value P2, and the second reference pressure value P3. When the leakage determination value P2 is less than the first reference pressure value P1, it is determined that the leakage does not occur. When the leakage determination value P2 is more than the first reference pressure value P1, it is determined that the leakage occurs.

However, we have discovered that when the vacuum pump 4 mounted on the ELCM module 1 fails, the air flow may not be generated in the ELCM module 1, the canister, or the fuel tank, and thus the fuel system leakage determination of the hybrid vehicle may not be performed.

SUMMARY

The present disclosure provides a leakage diagnosis supplement method for a failure of a vacuum pump using an active purge pump and a leakage diagnosis supplement system for a failure of the vacuum pump using the active purge pump which are capable of determining whether or not a leakage in a fuel system occurs even when the vacuum pump with an ELCM module fails.

In order to achieve the above-described object, according to an exemplary form of the present disclosure, a leakage diagnosis supplement method for a failure of a vacuum pump using an active purge pump includes: determining whether or not the vacuum pump mounted on a vent line between a canister and an atmosphere fails, reverse-rotating the active purge pump mounted on a purge line connecting the canister and an intake pipe to each other, determining whether or not an absolute value of internal pressure in a fuel tank is less than a specific value, and checking a leakage in a fuel system including the canister and the fuel tank.

In addition, when the absolute value of the internal pressure in the fuel tank is not less than the specific value, checking whether or not a leakage in the canister occurs may be performed.

In addition, when it is determined that the leakage in the fuel system occurs, checking whether or not the leakage in the canister occurs may be performed.

In addition, when it is determined that the leakage does not occur in the canister, it may be determined that a leakage in the fuel tank occurs.

In order to achieve the above-described object, according to one form of the present disclosure, there is provided a leakage diagnosis supplement system for a failure of a vacuum pump using an active purge pump, the system including a canister configured to absorb an evaporation gas from a fuel tank, a purge line configured to connect the canister and an intake pipe to each other, an active purge pump and PCSV configured to be mounted on the purge line, a vent line configured to connect the canister and an atmosphere, and a filter and an ELCM module configured to be mounted on the vent line. When the vacuum pump mounted on the ELCM module fails, the active purge pump reverse-rotates and diagnoses a leakage in the fuel tank or the canister based on a signal which is generated by a pressure sensor mounted on the ELCM module.

In addition, the ELCM module may include a switching valve switching connection between a plurality of flow paths which are provided inside of the ELCM module, air may be circulated in the ELCM module by a vacuum pressure which is generated in the vacuum pump when the switching valve is non-operated, and air in the canister and the fuel tank may be discharged to an atmosphere by the vacuum pressure which is generated in the vacuum pump when the switching valve is operated.

In addition, the active purge pump may reverse-rotate to move air from the canister toward the atmosphere when the vacuum pump mounted on the ELCM module fails.

In addition, the switching valve mounted on the ELCM module may be operated in a state where a value measured in the pressure sensor mounted on the ELCM module reaches a specific value which is less than the atmospheric pressure.

In such a configuration, according to a leakage diagnosis supplement method for a failure of a vacuum pump using an active purge pump and a leakage diagnosis supplement system for a failure of the vacuum pump using the active purge pump of one form of the present disclosure, even when the vacuum pump mounted on the ELCM module fails, air flow may be generated in the ELCM module, the canister, and the fuel tank by reverse-rotating the active purge pump, and thus it is possible to perform the fuel system leakage determination of the hybrid vehicle.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
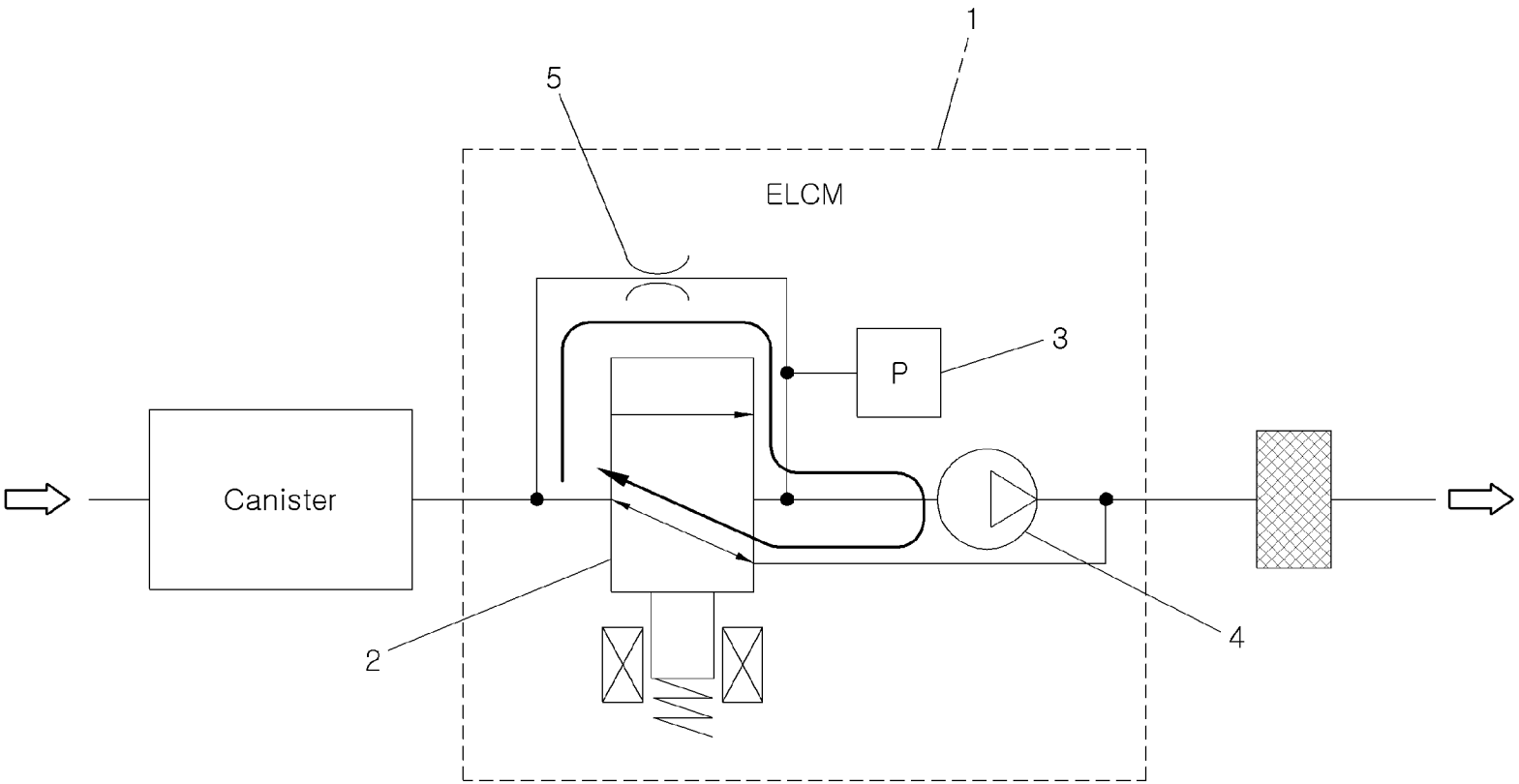
FIG. 1 (Prior Art)
FIGS. 1 and 2 are operating state diagrams showing an ELCM module in the related art.
Figure 2:
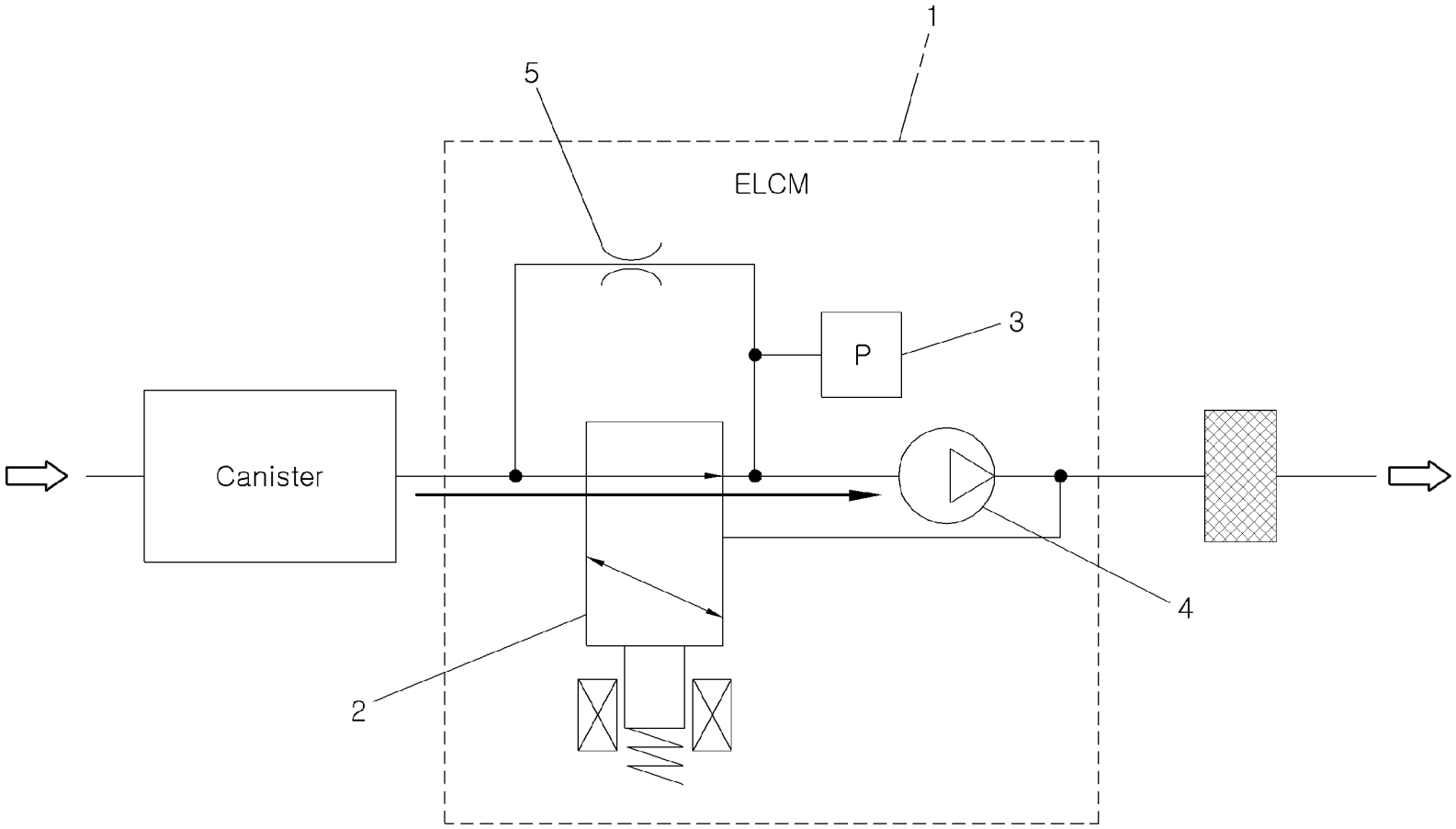
FIG.2(Prior Art)
Figure 3:
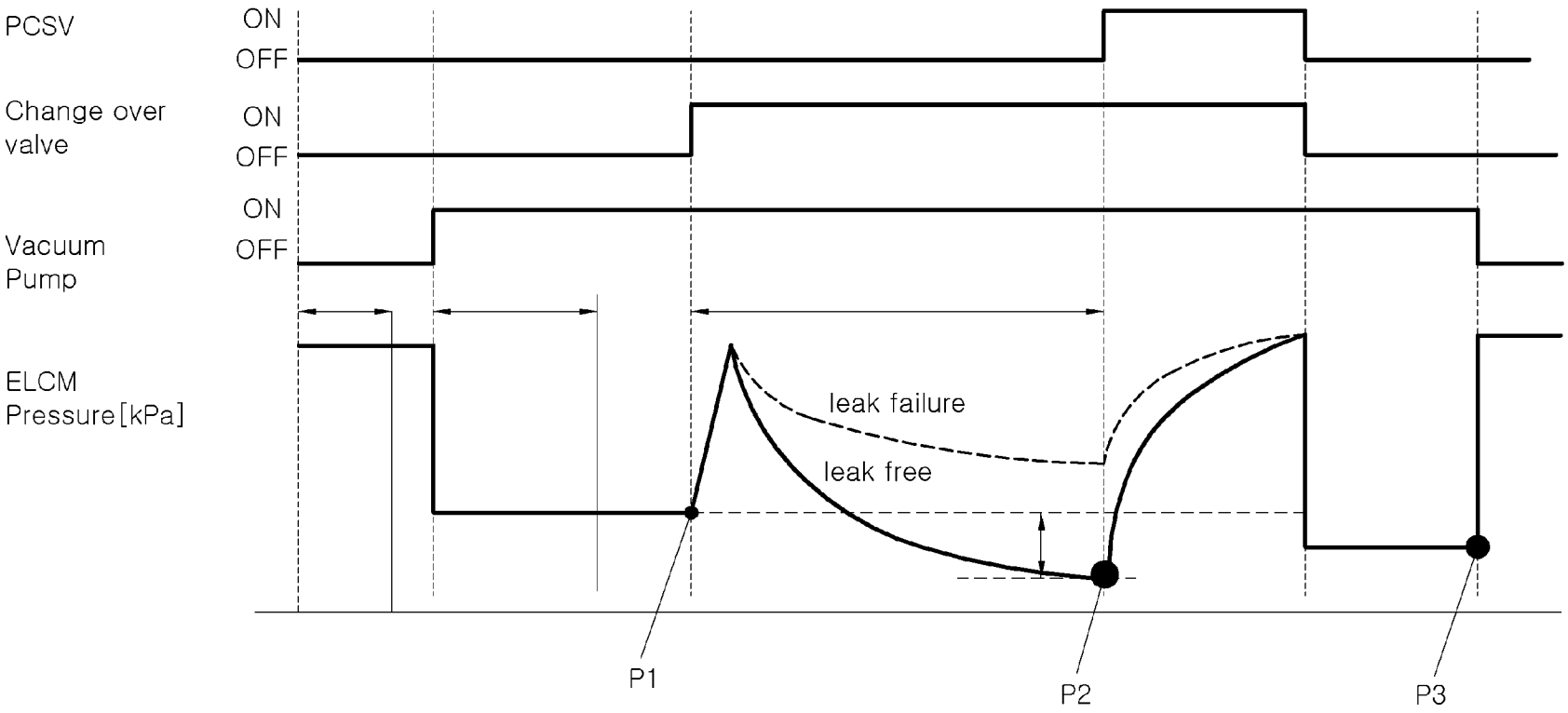
FIG.3(Prior Art)
FIG. 3 is a graph showing a signal generated in a pressure sensor mounted on the ELCM module in FIGS. 1 and 2.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, a leakage diagnosis supplement method for a failure of a vacuum pump 750 using an active purge pump 300 and a leakage diagnosis supplement system for a failure of the vacuum pump 750 using the active purge pump 300 according to one form of the present disclosure will be described with reference to the accompanying drawings.

Figure 4:
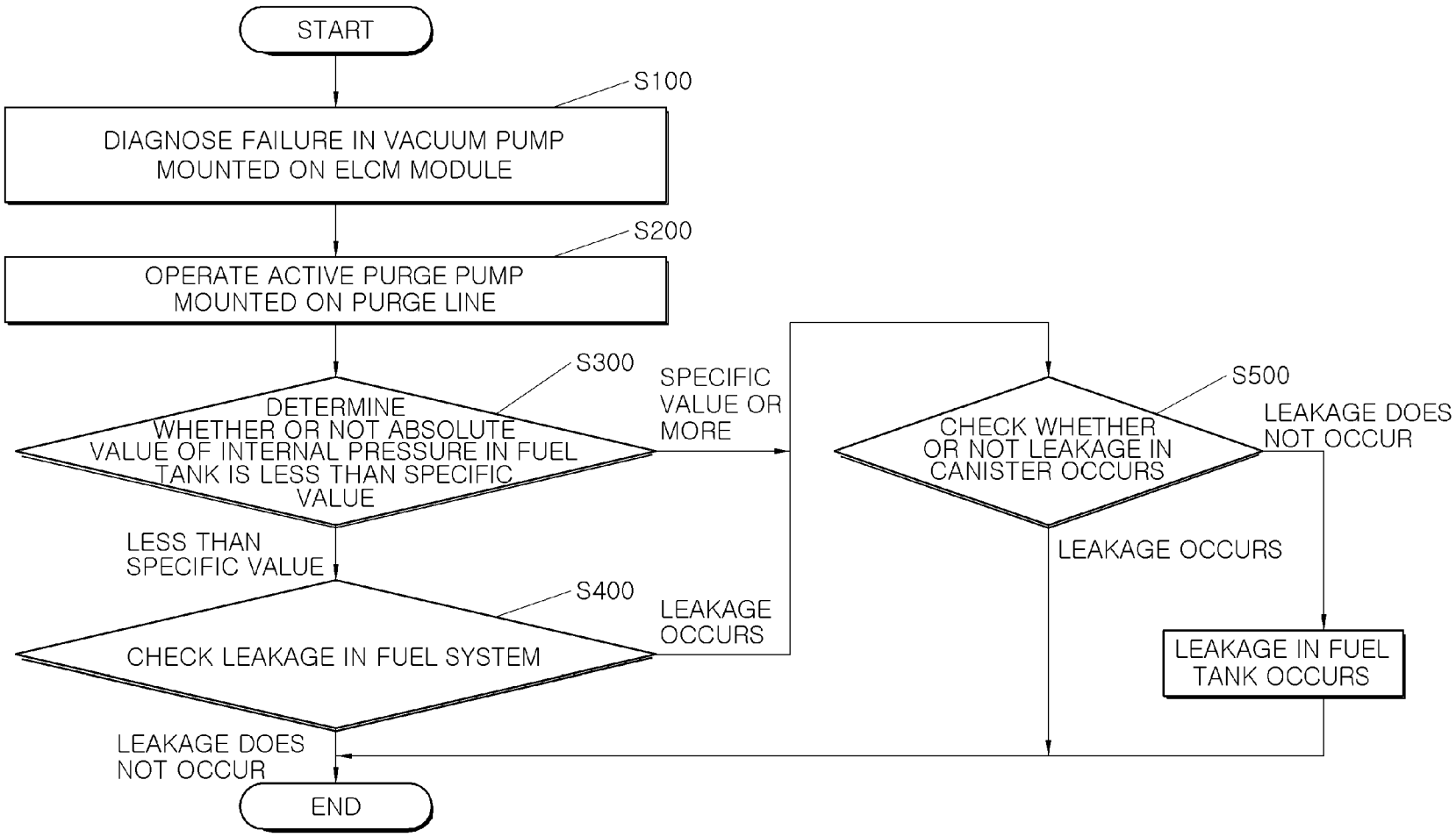
FIG. 4 is a flowchart showing a leakage diagnosis supplement method for a failure of a vacuum pump using an active purge pump according to one form of the present disclosure.

As shown in FIG. 4, the leakage diagnosis supplement method for a failure of the vacuum pump 750 using the active purge pump 300 according to one form of the present disclosure includes: a step S100 of determining whether or not the vacuum pump 750 mounted on a vent line 500 between a canister 100 and an atmosphere fails, a step S200 of reverse-rotating the active purge pump 300 mounted on a purge line 200 connecting the canister 100 and an intake pipe I to each other, a step S300 of determining whether or not an absolute value of internal pressure in a fuel tank T is less than a specific value, and step S400 of checking a leakage in the fuel system including the canister 100 and the fuel tank T.

In the step S100 of determining whether or not the failure of the vacuum pump 750 occurs, the failure of the vacuum pump 750 based on the signal generated in the pressure sensor 772 may be determined. When the signal generated in the pressure sensor 772 does not change even if the vacuum pump 750 is operated, it is determined that the vacuum pump 750 fails. After the vacuum pump 750 is operated so as to have an interval, the failure of the vacuum pump 750 may be determined by comparing the signal or the change in the signal generated in the pressure sensor 772 when the vacuum pump 750 is operated. In the step S100 of determining whether or not the failure of the vacuum pump 750 occurs, an atmosphere pressure is measured through the pressure sensor 772 mounted on an ELCM module 700.

Figure 5:
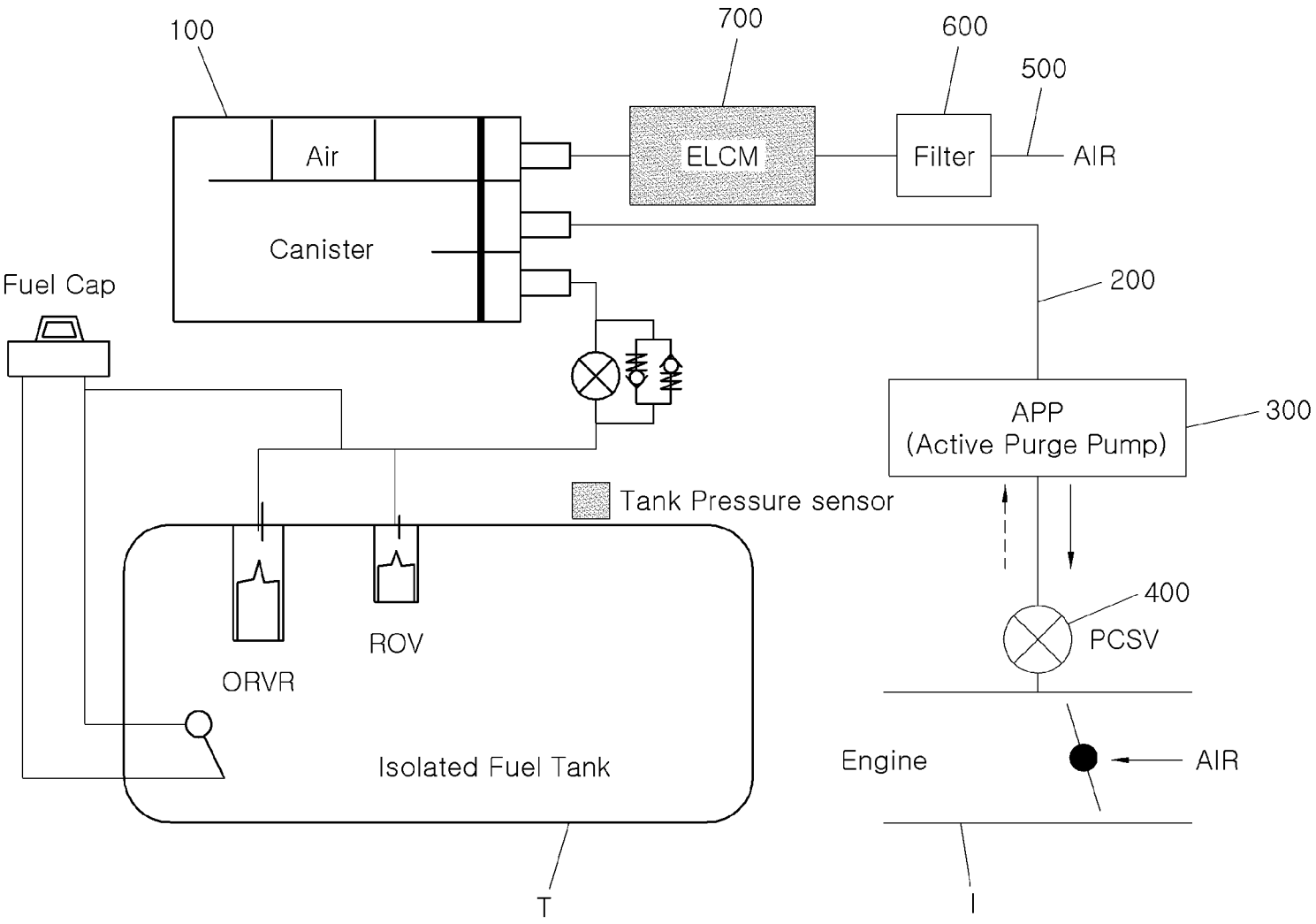
FIG. 5 is a view showing an example of a leakage diagnosis supplement system for a failure of the vacuum pump using the active purge pump according to one form of the present disclosure.

As shown in FIG. 5, a purge line 200 is mounted between the canister 100 and the intake pipe I. A purge control solenoid valve (PCSV) 400 is installed on the purge line 200. The active purge pump 300 is mounted on the purge line 200 so as to be positioned between the PCSV 400 and the canister 100. An air flows from the canister 100 toward the PCSV 400 when the active purge pump 300 normal rotates and the air flows from the canister 100 toward the vent line 500 when the active purge pump 300 reverse-rotates.

A pressure gauge (not shown) is installed between the canister 100 and the active purge pump 300, and between the active purge pump 300 and PCSV 400, respectively. The fuel tank T is connected to the canister 100 so as to adsorb an evaporated gas. The canister 100 is opened toward the atmosphere through the vent line 500. A filter 600 and an ELCM module 700 are mounted on the vent line 500.

When the evaporated gas collected in the canister 100 is purged, the active purge pump 300 normal rotates, a vacuum pressure is generated in the canister 100, and the evaporated gas is compressed between the PCSV 400 and the active purge pump 300. By compressing the evaporated gas between the PCSV 400 and the active purge pump 300, a pressure of the evaporated gas may be equal to or greater than the atmospheric pressure. Accordingly, even when a turbo charger is installed on the intake pipe I, the evaporated gas may be injected to the intake pipe I.

Particularly, by adjusting a rotation speed of the active purge pump 300, a timing of opening and closing the PCSV 400, and an opening degree of the PCSV 400, an amount of the evaporated gas flowing into the intake pipe I may be adjusted. In addition, as the evaporated gas flows into the intake pipe I, an amount of hydrocarbon to be additionally supplied into a combustion chamber may be adjusted. When a fuel injection quantity and the amount of hydrocarbon to be additionally supplied into the combustion chamber are adjusted in combination, combustion of the rich fuel may be prevented. It may be minimized the generation of contaminants caused by purging of the evaporated gas.

Figure 6:
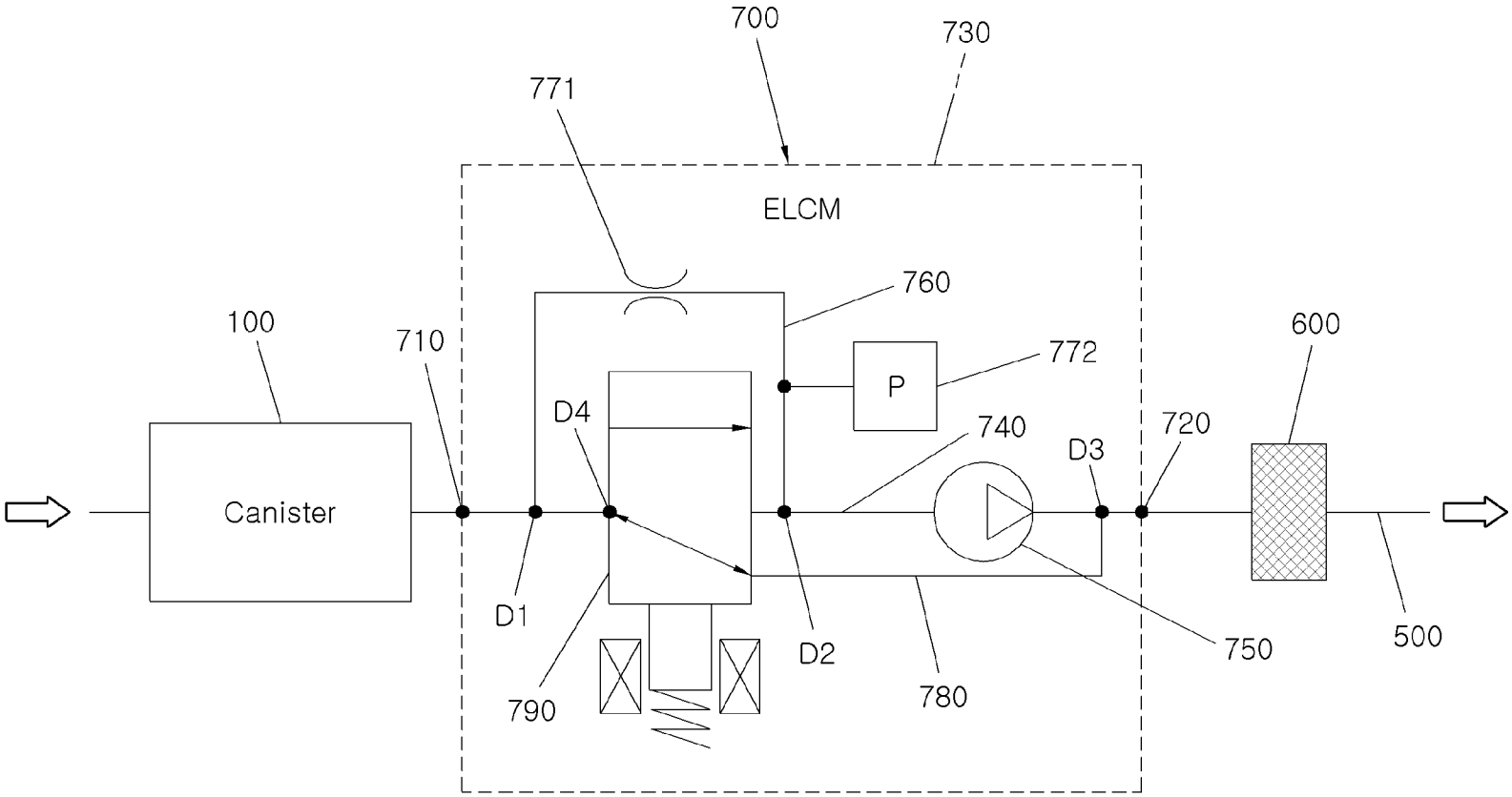
FIGS. 6 and 7 are operating state diagrams showing an ELCM module in the FIG. 5.

In the step S200 of operating the active purge pump 300, the PCSV 400 maintains a closed state. The active purge pump 300 reverse-rotates in an opposite direction which is different than when the evaporated gas is purged. The active purge pump 300 reverse-rotates from the canister 100 toward the vent line 500 so as to generate the air flow. As shown in FIG. 6, the air flow is generated in the ELCM module 700 by reverse-rotating the active purge pump 300. By adjusting the rotation speed of the active purge pump 300, a magnitude of a pressure generated in the canister 100, the fuel tank T, the ELCM module 700, and the vent line 500 may be adjusted.

The ELCM module 700 includes a switching valve 790 changing a connection between a plurality of flow paths which are provided in the ELCM module 700. When the switching valve 790 is non-operated, an air is circulated in the ELCM module 700 by a vacuum pressure generated in the vacuum pump 750. When the switching valve 790 is operated, the air in the canister 100 and the fuel tank T is discharged to the atmosphere by the vacuum pressure generated in the vacuum pump 750.

Figure 7:
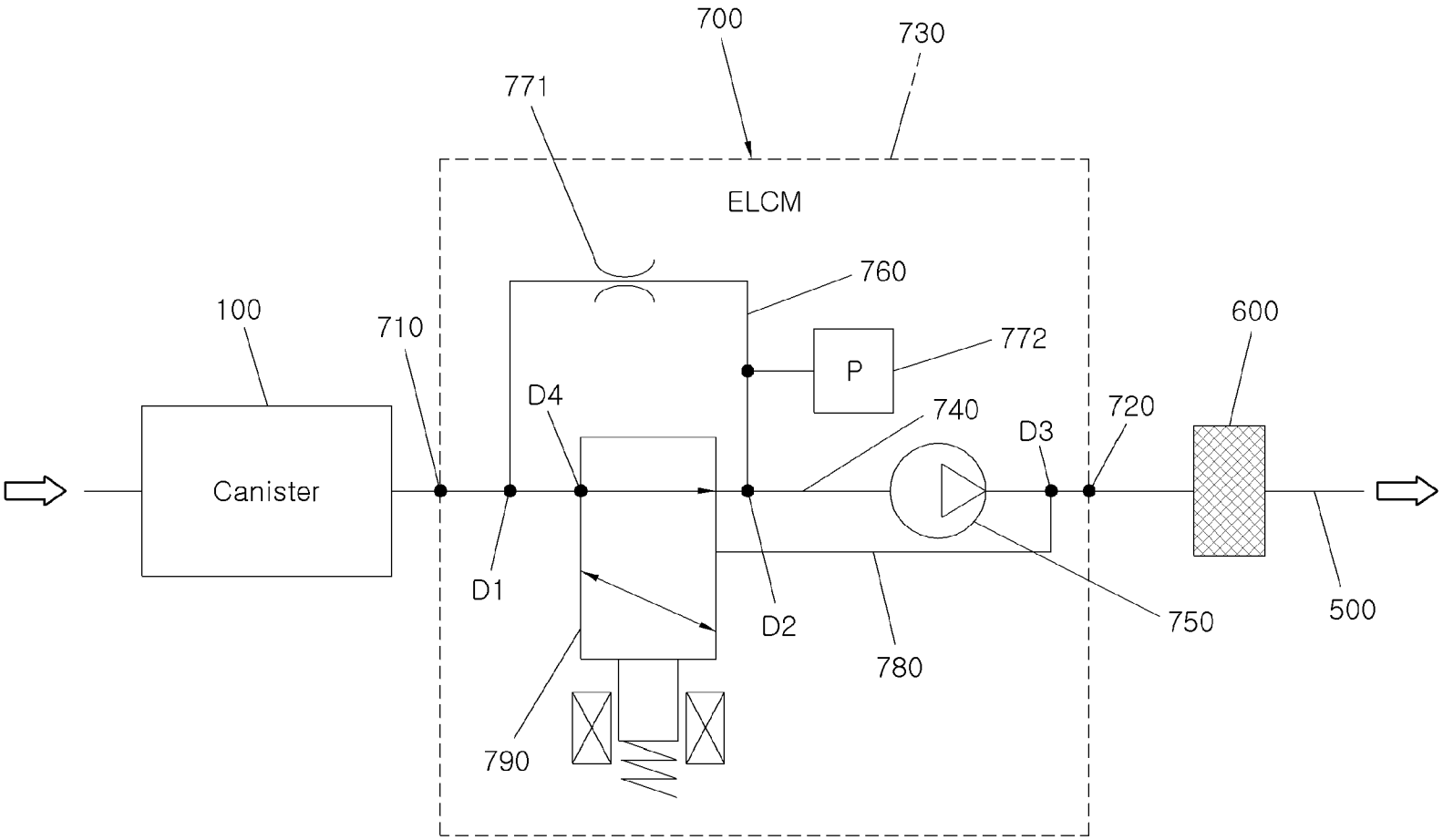

As shown in FIGS. 6 and 7, the ELCM module 700 includes a first port 710 connected to the canister 100; a second port 720 connected to the filter 600 so as to open toward the atmosphere; a housing 730 having the first port 710 and the second port 720 formed on outside; a first flow path 740 formed inside the housing 730 so as to connect the first port 710 and the second port 720 to each other; the vacuum pump 750 mounted on the first flow path 740; a second flow path 760 connecting a first branch point D1 and a second branch point D2, on the first flow path 740, to each other; a reference orifice 771 and the pressure sensor 772 formed on the second flow path 760; a third flow path 780 connecting a third branch point D3 and a fourth branch point D4, on the first flow path 740, to each other; and the switching valve 790 mounted on the first flow path 740 and the third flow path 780 so as to disconnect the first flow path 740 and communicate the third branch point D3 and the fourth branch point D4 at the time of non-operating, and to disconnect the third flow path 780 and communicate the fourth branch point D4 and the second branch point D2 at the time of operating.

The air flowing into the first port 710 flows into the second flow path 760 through the first branch point D1. The air reaching the pressure sensor 772 passes through the reference orifice 771, so that the flow rate remains constant. Since the flow rate of the air reaching the pressure sensor 772 is constant, the value obtained by converting the signal generated in the pressure sensor 772 into a figure reaches a constant value depending on various environment variables. The reaching value is measured as a first reference pressure value P1.

The air flows into the first flow path 740 through the second branch point D2, and then flows into the third flow path 780 through the third branch point D3. The air discharged from the first flow path 740 to the third flow path 780 flows into the first flow path 740 through the switching valve 790 and the fourth branch point D4, and is flowed into the second flow path 760 through the first branch point D1 again.

Accordingly, in the step S200 of reverse-rotating the active purge pump 300, the air, which flows into the second flow path 760 by the reverse-rotating the active purge pump 300, a rear end of the first flow path 740 with reference to the switching valve 790, the third flow path 780, and a front end of the first flow path 740 with reference to the switching valve 790, flows in the ELCM module 700 repeatedly.

In the step S300 of determining whether or not an absolute value of an internal pressure in the fuel tank T is less than a specific value, the internal pressure in the fuel tank T is sensed through the pressure gauge mounted on the fuel tank T. The absolute value of the sensed internal pressure in the fuel tank T compares with a predetermined specific value.

When the absolute value of the internal pressure in the fuel tank T is less than the specific value, the step S400 of checking the leakage in fuel system is performed. In the step S400 of checking the leakage in the fuel system, the switching valve 790 is operated. As shown in FIG. 7, the flowing air generated in the canister 100 and the fuel tank T caused by reverse-rotation of the active purge pump 300 is discharged to the atmosphere through the first port 710, the front end of the first flow path 740 with reference to the switching valve 790, the switching valve 790, the rear end of the first flow path 740 with reference to the switching valve 790, the second port 720, the filter 600, and the vent line 500.

Figure 8:
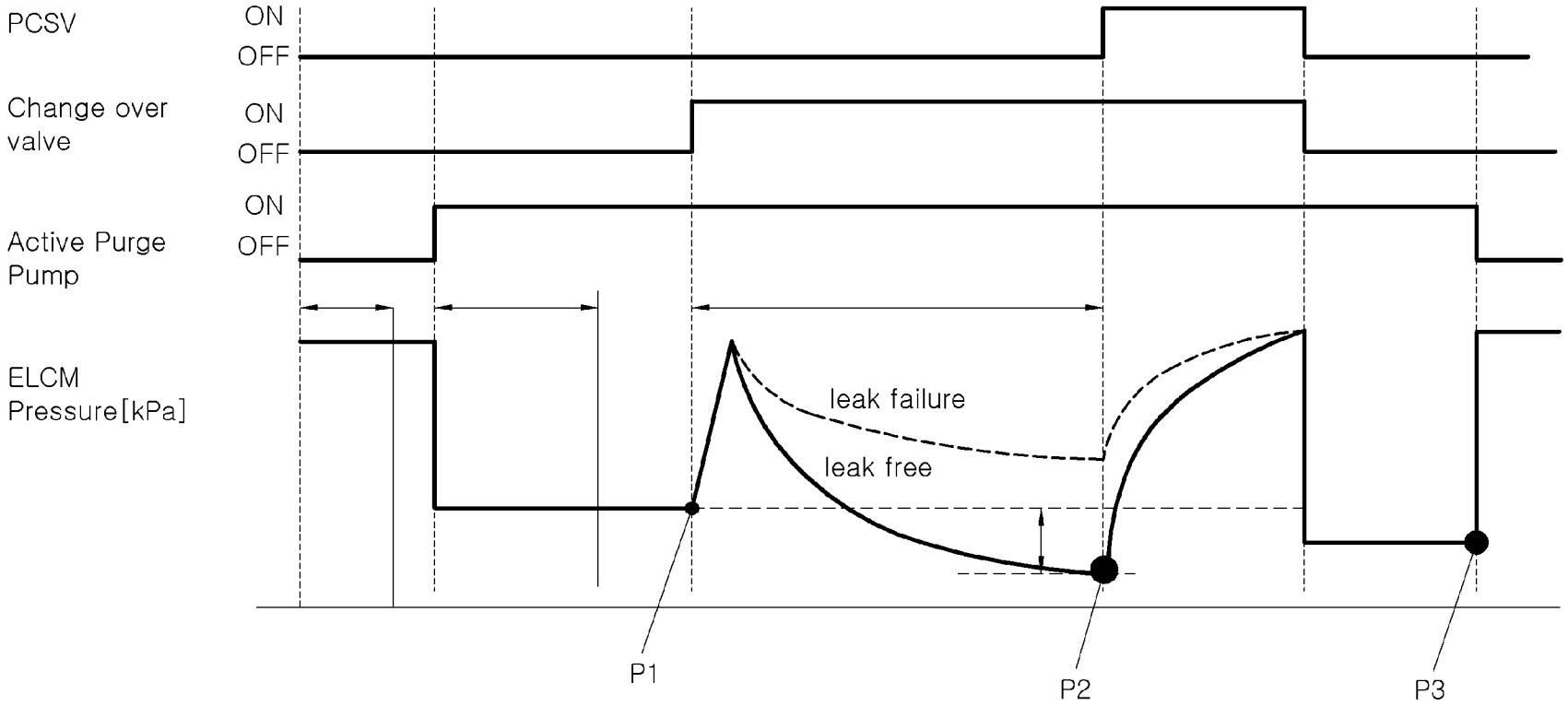
FIG. 8 is a graph showing a signal generated in a pressure sensor mounted on the ELCM module in FIG. 5.

As shown in FIG. 8, the value obtained by converting the signal continuously generated in the pressure sensor 772 into a figure nonlinearly decreases depending on various environmental variables and reaches a specific value. At this time, the reached specific value is measured as a leakage determination value P2.

After the leakage determination value P2 is measured, the PCSV 400 is operated to be opened. As the PCSV 400 is opened, an outside air flows into the purge line 200. As the outside air flows into the purge line 200, as shown in FIG. 8, the value obtained by converting the signal continuously generated in the pressure sensor 772 into a figure nonlinearly increases depending on various environment variables, and is the same as that obtained by converting the signal generated into a figure when the atmospheric pressure is measured in the step S100 of determining whether or not the vacuum pump 750 fails in advance. The failure of the PCSV 400 is diagnosed based on the nonlinear change in the intensity of the signal generated in the pressure sensor 772, in a state where the PCSV 400 is open.

When intensity of the signal continuously generated in the pressure sensor 772 is the same intensity as that of the signal generated when the atmospheric pressure is measured, the switching valve 790 is operated to be in a non-operated state and the PCSV 400 is also operated to be closed. Since the switching valve 790 is in a non-operated state, the air in the ELCM module 700 is recirculated and the value obtained by converting the signal generated in the pressure sensor 772 into a figure reaches a constant value depending on various environment variables as in the step S200 of reverse-rotating the active purge pump 300. This reached value is measured as a second reference pressure value P3.

The first reference pressure value P1 and the second reference pressure value P3 are compared with each other to check malfunction of the ELCM module 700. When the leakage determination value P2 is less than the first reference pressure value P1 measured in the step S200 of reverse-rotating the active purge pump 300 in advance, it is determined that the leakage in the fuel system does not occur. When the leakage determination value P2 is more than the first reference pressure value P1, it is determined that the leakage in the fuel system occurs.

When it is determined that the absolute value of the internal pressure in the fuel tank T is not less than the specific value in the step S300 of determining whether or not the absolute value of the internal pressure in the fuel tank T is less than the specific value, or when it is determined that the leakage in the fuel system occurs in the step S400 of checking the leakage in the fuel system, the step S500 of checking whether or not the leakage in the canister 100 occurs is performed. In the step S500 of checking whether or not the leakage in the canister 100 occurs, the measurement target is limited to the canister 100. Accordingly, a valve mounted on a line connecting the canister 100 and the fuel tank T to each other is locked, so that the air flow caused by reverse-rotating of the active purge pump 300 is not generated in the fuel tank T.

The switching valve 790 is operated again. As shown in FIG. 7, the flowing air generated in the canister 100 is discharged to the atmosphere through the first port 710, the front end of the first flow path 740 with reference to the switching valve 790, the switching valve 790, the rear end of the first flow path 740 with reference to the switching valve 790, the second port 720, and the vent line 500 by operating the switching valve 790.

At this time, the air existing in the second flow path 760 is flowed into the first flow path 740 through the first branch point D1 and the second branch point D2. Accordingly, as shown in FIG. 8, the intensity of the signal shows an aspect in which the value obtained by converting the signal continuously generated in the pressure sensor 772 into a figure nonlinearly decreases and reaches the specific value. At this time, the reached specific value is measured as a leakage determination value P2.

After the leakage determination value P2 is measured, the PCSV 400 is operated to be opened. As the PCSV 400 is opened, an outside air flows into the purge line 200. As the outside air flows into the purge line 200, as shown in FIG. 8, the value obtained by converting the signal continuously generated in the pressure sensor 772 into a figure nonlinearly increases and the intensity of the signal is the same as that of the signal generated when the atmospheric pressure is measured in the step of determining whether or not the vacuum pump 750 fails in advance. The failure of the PCSV 400 is diagnosed based on the change of the nonlinear signal generated in the pressure sensor 772, in a state where the PCSV 400 is open.

In addition, the switching valve 790 is operated to be in a non-operated state and the PCSV 400 is also operated to be closed. The switching valve 790 is in a non-operated state, so that the air is circulated in the ELCM module 700 as in the step S200 of reverse-rotating the active purge pump 300. At this time, the second reference pressure value P3 is measured through the pressure sensor 772.

The first reference pressure value P1 and the second reference pressure value P3 are compared with each other to check malfunction of the ELCM module 700. When the leakage determination value P2 is less than the first reference pressure value P1 measured in the step S200 of reverse-rotating the active purge pump 300 in advance, it is determined that the leakage in the canister 100 does not occur and, at the same time, it is determined that the leakage in fuel tank T occurs. When the leakage determination value P2 is more than the first reference pressure value P1, it is determined that the leakage in the canister 100 occurs.

In such a configuration, according to a leakage diagnosis supplement method for a failure of a vacuum pump 750 using an active purge pump 300 and a leakage diagnosis supplement system for a failure of the vacuum pump 750 using the active purge pump 300 of one form of the present disclosure, even when the vacuum pump 750 mounted on the ELCM module 700 fails, air flow may be generated in the ELCM module 700, the canister 100, and the fuel tank T by reverse-rotating the active purge pump 300, and thus the fuel system leakage determination of the hybrid vehicle may be performed.

What is claimed is:

1. A leakage diagnosis supplement method for a fuel system, where the fuel system includes: a canister to adsorb an evaporation gas from a fuel tank; a purge line connecting the canister to an intake pipe; an active purge pump and a purge control solenoid valve (PCSV) mounted on the purge line; a vent line connecting the canister to an atmosphere; an evaporative leak check monitor (ELCM) module mounted on the vent line between the canister and the atmosphere to diagnose a leakage in the fuel system at an engine stop state; a pressure sensor installed in the ELCM module; a vacuum pump mounted on the ELCM module to generate an air flow in the ELCM module; and a filter provided in the vent line behind the ELCM module, the leakage diagnosis supplement method comprising:

determining whether the vacuum pump mounted on the ELCM module fails; in response to determining that the vacuum pump fails, rotating the active purge pump in a first direction to move an air flow from the canister towards the vent line and determining the leakage in the fuel system including the fuel tank and the canister based on a signal generated by the pressure sensor installed in the ELCM module;

comparing an absolute value of an internal pressure sensed by a pressure gauge mounted on the fuel tank with a reference value; and in response to determining that the absolute value of the internal pressure sensed by the pressure gauge mounted on the fuel tank is less than the reference value, determining that the leakage occurs in the fuel tank and does not occur in the canister.

2. The leakage diagnosis supplement method of claim 1, further comprising:

circulating an air in the ELCM module by a vacuum pressure which is generated in the vacuum pump when a switching valve of the ELCM module is non-operated, where the switching valve switches connection between a plurality of flow paths provided inside of the ELCM module; and discharging an air in the canister and the fuel tank to the atmosphere by the vacuum pressure which is generated in the vacuum pump when the switching valve is operated.

3. The leakage diagnosis supplement method of claim 2, further comprising:

operating the switching valve of the ELCM module in a state where a value measured by the pressure sensor mounted on the ELCM module reaches a specific value less than an atmospheric pressure.

4. The leakage diagnosis supplement method of claim 1, further comprising:

rotating the active purge pump in a second direction opposite to the first direction to move the air flow from the canister toward the PCSV; and rotating the active purge pump in the first direction to move the air flow from the canister toward the atmosphere through the vent line when the vacuum pump mounted on the ELCM module fails.

* * * * *